US006095871A

United States Patent [19]

Zahora et al.

[11] Patent Number: 6,095,871

[45] Date of Patent: Aug. 1, 2000

[54] RECEPTACLE ASSEMBLY FOR ELECTRIC POWER LEADS

[75] Inventors: Joseph A. Zahora, Kettering; Johnny D. Yu, Centerville, both of Ohio

[73] Assignee: Dayton-Phoenix Group, Inc., Dayton, Ohio

[21] Appl. No.: 09/028,914

[22] Filed: Feb. 24, 1998

[51] Int. Cl.[7] ..... H01R 13/502

[52] U.S. Cl. ..... 439/695; 439/589

[58] Field of Search ..... 439/271, 274, 439/278, 279, 587–589, 695, 607, 610

[56] References Cited

U.S. PATENT DOCUMENTS

| | | | |
|---|---|---|---|
| 3,613,047 | 10/1971 | Kron et al. . | |
| 3,933,404 | 1/1976 | Oehlerking et al. . | |
| 4,810,206 | 3/1989 | Rosenfeld et al. | 439/325 |
| 4,820,204 | 4/1989 | Batty | 439/681 |
| 4,927,386 | 5/1990 | Neuroth | 439/589 |
| 5,273,445 | 12/1993 | Ehrenfels et al. | 439/134 |
| 5,286,220 | 2/1994 | Watson | 439/589 |
| 5,362,258 | 11/1994 | Arnswald et al. | 439/695 |
| 5,449,302 | 9/1995 | Yarbrough et al. | 439/680 |
| 5,458,507 | 10/1995 | Colescott | 439/589 |
| 5,498,179 | 3/1996 | Byczek | 439/843 |
| 5,823,811 | 10/1998 | Blanchfield et al. | 439/274 |

*Primary Examiner*—Khiem Nguyen
*Attorney, Agent, or Firm*—Thompson Hine & Flory LLP

[57] ABSTRACT

A receptacle assembly apparatus for electric power leads that includes a receptacle, a backshell, and a disk-shaped member clamped therebetween. The receptacle has a housing and a grommet having orifices formed therethrough to receive power leads and associated pins. The disk-shaped member is formed of a relatively hard dielectric material such as nylon and contains orifices therethrough, corresponding to orifices in the grommet, which receive the electric power leads and associated pins. The lead pins have annular ribs formed thereon such that the ribs are captured between a collar on the disk-shaped member and a protrusion on the grommet, thereby preventing relative rearward movement of the lead pins and associated leads.

18 Claims, 3 Drawing Sheets

RECEPTACLE ASSEMBLY FOR ELECTRIC POWER LEADS

BACKGROUND OF THE INVENTION

This invention relates to the field of electrical connecting devices, and more particularly, to connectors used for heavy duty three-phase electric motors.

Many three-phase electric motors, such as those used in locomotive applications, operate at relatively high currents requiring heavy duty power leads. Furthermore, the environments in which these leads are used can be quite extreme, including exposure to high temperature and stresses.

Some three phase motors require connectors. These connectors typically include a male component, or receptacle assembly, which is designed to releasably connect to a female component, or plug, which in turn is connected to a power supply by cables. The receptacle assembly includes a housing which receives a grommet that, in turn, receives the metal tips or pins of the power leads from the motor. The grommet is made of a flexible silicon rubber and includes holes shaped to receive and grip the power leads so that the tips protrude toward the plug. A backing disk is positioned behind the grommet and is retained in place by a backshell which threads onto the housing. The plug also includes a backshell and a housing having a disk which contains female sockets in a spaced array, corresponding to the orientation of the pins in the grommet of the receptacle, and which are connected to the power supply cables. The backshell for the plug is threaded to engage a threaded flange of the receptacle housing.

A disadvantage associated with this construction is that, when the sockets of the plug are inserted over the pins of the receptacle, any misalignment of the pins with respect to the corresponding sockets may result in one or more of the pins contacting the facing surface of the plug grommet and being pushed rearwardly from its seated and protruding position within the receptacle grommet. As a result, such pins do not make an electrical connection with their respective sockets, and upon powering up, severe damage to the motor results. It has been learned that, if the force necessary to push one or more pins rearwardly from its grommet is at least 200 pounds, the likelihood of not making a full connection is significantly reduced.

Accordingly, there exists a need for a receptacle assembly for a three phase motor which insures integrity of electrical connection and is able to withstand temperatures of 125° C.

SUMMARY OF THE INVENTION

The present invention is a receptacle assembly for electric power leads and associated pins such that relative rearward and radial movement of the leads is prevented in response to forces of at least 200 pounds (889.6N). The present invention includes a disk-shaped member which is made of a relatively hard material, having orifices shaped to receive the power leads and associated pins therethrough. The disk-shaped member is positioned between the flexible grommet and the backshell of the male component of the receptacle, which threadably connect with one another, thereby securing the disk-shaped member against the rubber grommet.

Preferably, the disk-shaped member is formed from a dielectric material which can withstand temperatures greater than 125° C., such as nylon. The disk-shaped member includes a plurality of orifices shaped to receive the leads so that the member may be positioned immediately behind the grommet. Each orifice of the disk-shaped member includes a recess extending around its periphery that is positioned to engage an annular protrusion around a corresponding orifice on the adjacent grommet. Each orifice further includes an annular collar which engages an annular rib on an associated pin of a lead such that the rib is captured and prevented from relative rearward movement when the plug is inserted over the receptacle.

Accordingly, it is an object of the present invention to provide a receptacle assembly which prevents displacement of power lead pins from a receptacle below a force of approximately 200 pounds (889.6N); a receptacle assembly which facilitates a secure electrical connection with an associated plug; and a receptacle assembly which is relatively inexpensive to fabricate.

Other objects and advantages of the present invention will be apparent from the following description, the accompanying drawings and the appended claims.

DETAILED DESCRIPTION

Figure 1:
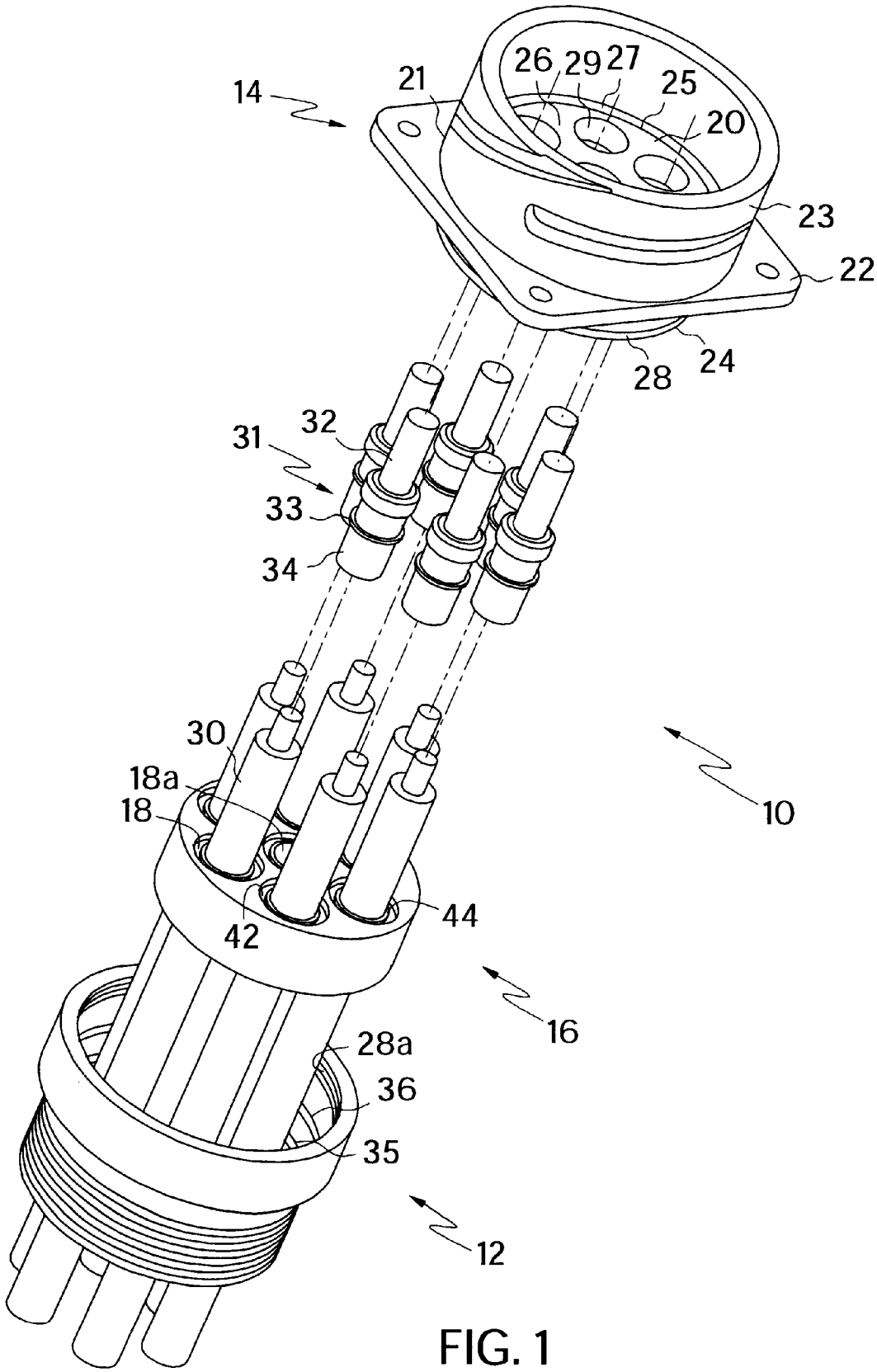
FIG. 1 is an exploded, perspective view of a preferred embodiment of the receptacle assembly for electric power leads of the present invention.

As shown in FIG. 1, in accordance with a preferred embodiment of the present invention, a receptacle assembly, generally designated 10, includes an annular backshell 12, an annular receptacle 14, and a disk-shaped member 16. Disk-shaped member 16 includes orifices 18 formed therethrough and spaced about the periphery of the disk, as well as one center orifice 18A. The disk-shaped member 16 is coaxial with the backshell 12 and receptacle 14 and is captured between those components when they are joined together, as will be described in detail below.

Figure 2:
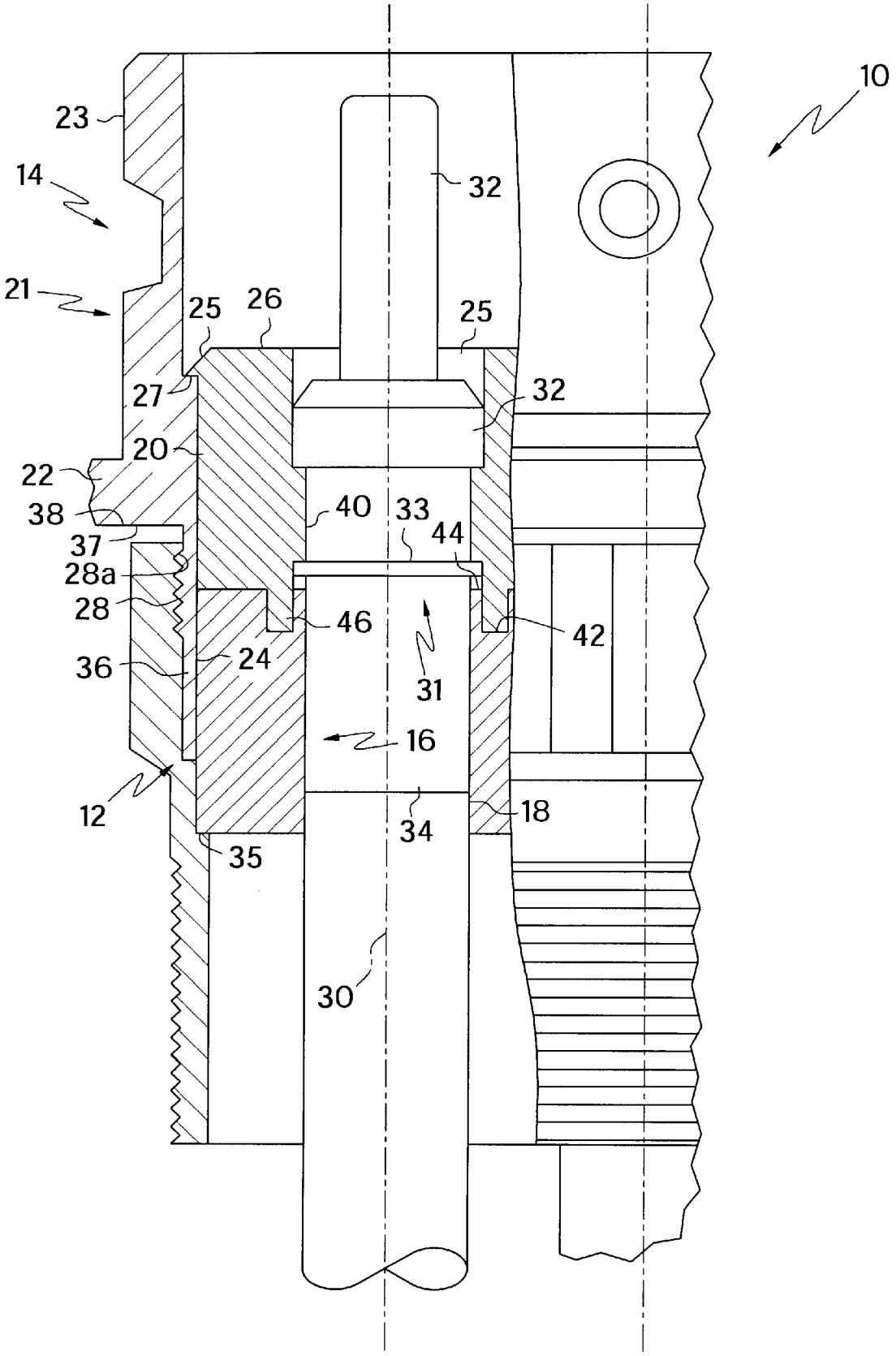
FIG. 2 is a detail side elevation in section of the receptacle assembly of FIG. 1.

As shown in FIGS. 1 and 2, the receptacle 14 consists of a grommet 20 and a receptacle housing 21 composed of a base 22, upper flange 23, and lower flange 24. The upper flange 23 is threaded on its outer surface to engage the radially extruding pins of, and receive, a straight plug (not shown) of conventional design having a female insert. As shown in FIG. 2, the grommet 20, preferably made of a relatively flexible material, such as silicone rubber, is retained within the receptacle housing 21 by a beveled projection 25 formed on the outer periphery of the outer face 26 of the grommet. Projection 25 engages an associated ledge 27 within the upper flange 23 of the receptacle housing 21. The grommet 20 is further secured by means of a suitable adhesive. The lower flange 24 includes threads 28 which engage corresponding threads 28A formed on the inner surface of the backshell 12. When the backshell 12 is threaded onto the receptacle housing 21, the disk-shaped member 16 is clamped flush against the grommet 20.

The grommet 20 has orifices 29 formed therethrough, and aligned with orifices 18, to receive power leads 30 and associated pins 31. Each pin 31 is composed of a head 32, an annular rib 33, and a crimping flange 34. The crimping flange 34 is compressed against the power lead 30 in order to keep the pin 31 attached to the lead 30. The receptacle assembly of FIG. 1 is useful in any heavy duty electrical connecting application, but is particularly useful in the connecting of three phase electric motors.

The disk-shaped member 16 is prevented from relative rearward movement by a shoulder 35, extending radially inwardly within backshell 12. Accordingly, when the backshell 12 is engaged with the lower flange 19, the disk shaped member 16 is captured between the grommet 20 and the shoulder 35. Similarly, the backshell 12 contains another annular shoulder 36 which reduces the inside diameter of the backshell 12 to approximately the diameter of the disk-shaped member 16, so that the member is properly located within the backshell 12. The backshell 12 is shaped to provide clearance between the outer face 37 and the underside 38 of the base 22, when the backshell 12 is fully threaded onto the lower flange 24, so that the disk-shaped member 16 is firmly seated against the shoulder 35 and against the underside of the grommet 20. The grommet orifices 29 each contain a cylindrical constriction 40 which engages the annular rib 33 and head 32. This constriction 40 prevents some rearward movement of the power lead pin 31 and associated lead 30, but only up to approximately 24 pounds (106.75N) of force. In order to prevent rearward movement up to 200 pounds of force or more, the disk-shaped member 16 must be employed.

Figure 3A:
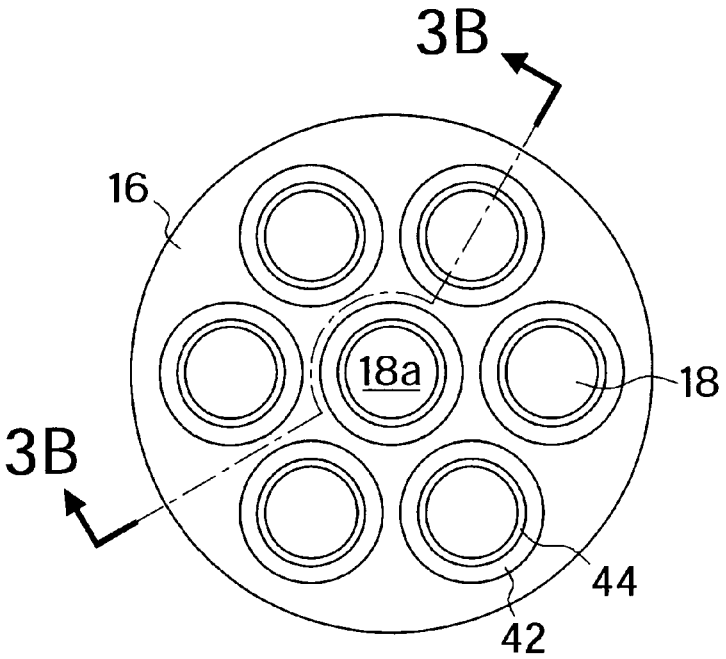
FIG. 3A is a top plan view of the disk-shaped member of the assembly FIG. 1.
Figure 3B:
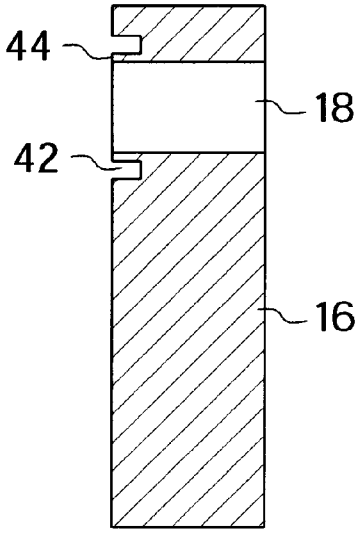
FIG. 3B is a side elevational view in section taken at line 3B—3B of FIG. 3A.

As shown in FIGS. 2, 3A and 3B, the disk-shaped member 16 preferably is made of a hard dielectric material such as nylon. Each of the orifices 18 is surrounded by a spaced, annular recess 42 that forms a protruding collar 44 between the orifice and the recess. Relative rearward movement of the power lead pin 31, and thus the power lead 30, is prevented by the engagement of the annular rib 33 and the collar 44. The recess 42 is shaped to receive an annular protrusion 46 formed on the grommet 20 and extending rearwardly therefrom, thereby allowing the disk-shaped member 16 to sit flush against the grommet 20. The recesses 42 receive the protrusions 46 to facilitate the alignment of the disk-shaped member 16 with the grommet 20.

In an alternate embodiment, the collar 44 is removed, so that there is a slight clearance between the annular rib 33 and the recess 42. However, this embodiment is somewhat less effective because the power lead pin 29 will be pushed a slight distance from the grommet 20 before engaging the disk-shaped member 16, thereby halting its movement.

The operation of the receptacle assembly, as best shown in FIG. 1., is as follows. A power lead 30 and associated pin 31 are inserted into an the underside of an orifice 29 in a silicon rubber grommet 20 attached within a receptacle housing 14. The pin 31 is restricted from being pushed through the grommet 20 by a constriction 40 in the orifice 29 which engages the head 32 and annular rib 33 formed on the pin 31. The engagement of the pin 31 and the constriction 40 prevents relative rearward movement of the pin 31 and associated lead 30 up to about 24 pounds (106.75N) of force.

An orifice 18 of the disk-shaped member 16 is then slipped over a power lead 30 such that the upper surface of the disk-shaped member 16 is facing the lower surface of the grommet 20. The disk-shaped member 16 is positioned so that the upper side of the disk-shaped member 16 is pressed flush against the underside of the grommet 20 and the recesses 42 in the disk-shaped member 16 engage the protrusions 46 on the grommet 20. This engagement of the recesses 42 and protrusions 46 insure proper alignment of the orifices 29 of the grommet 20 with the corresponding orifices 18 of the disk-shaped member 16. When the recesses 42 are engaged with the protrusions 46 on the grommet 20, the collars 44 on the disk-shaped member 16 are coaxial within the protrusions 46. Preferably, the collars 44 are coplanar with the upper side of the disk-shaped member 16 forming a small gap between the annular rib 33 and the surface of the collar 44.

The backshell 12 is then placed over the power lead 30 and is threaded to the lower flange 24 of the receptacle housing 14. The backshell 12 is tightened on the threads 28 of the lower flange 24 such that the shoulder 35 of the backshell 12 captures and retains the disk-shaped member 16 snugly against the grommet 20, preventing the disk-shaped 16 member from relative rearward movement. Preferably, the disk-shaped member 16 has an axial width sufficient to stop the backshell 12 from contacting the underside of the base 22 when the backshell 12 is fully tightened on the lower flange 24 of the receptacle housing 14.

With the backshell 12 fully tightened, the collar 44 on the disk-shaped member 16 acts to obstruct the annular rib 33 on the pin 31 and thus the power lead 30 from relative rearward movement when a straight plug (not shown) having a female insert is engaged with the receptacle housing. This rearward movement is prevented below a force of up to 200 pounds (889.6N).

While the form of the apparatus herein described constitutes a preferred embodiment of the invention, it is to be understood that the invention is not limited to this precise form of apparatus, and that changes may be made therein without departing from the scope of the invention.

What is claimed is:

1. A receptacle assembly for retaining electric power leads comprising:

a pin retainer made of a relatively inflexible, heat resistant nylon having a plurality of orifices therethrough, each shaped to receive an electric power lead and associated pin such that relative rearward movement of said lead is prevented, wherein each of said pin retainer orifices includes a recess, spaced from a periphery of said orifice, forming an annular collar about said power lead pin, each of said collars being shaped to engage an annular rib formed on said power lead pin;

a cylindrical backshell having an internal shoulder shaped to seat said pin retainer and prevent relative rearward movement thereof, such that said annular rib is clamped against said collar when a receptacle is connected to said backshell; and said receptacle having a housing shaped to threadably engage said backshell, and a grommet of silicone rubber shaped to engage said pin retainer and having a plurality of orifices therethrough, positioned to correspond to said pin retainer orifices when said receptacle is connected to said backshell, and receive said electric power leads, such that, when said receptacle is attached to said pin retainer and said backshell, relative rearward movement of said electric power leads and associated pins is prevented below a predetermined force of approximately 200 pounds (889.6N), and wherein said grommet orifices include constrictions to engage said lead pins, said grommet further including annular recesses positioned to engage and capture said annular ribs, and annular protruding ridges shaped to engage said pin receptacle orifice recesses; and wherein said receptacle housing is shaped to engage said backshell such that such engagement clamps said pin retainer against said grommet.

2. A receptacle assembly for retaining electric power leads comprising:

a disk-shaped member made of a relatively inflexible material and having at least one orifice therethrough shaped to recieve an electric power lead pin including a recess extending about the periphery of said orifice wherein said recess is spaced from said periphery to form a collar adjacent to said periphery and said collar is shaped to engage an annular rib formed on said power lead pin such that relative rearward movement of said power lead pin and attached power lead is prevented;

a backshell having a shoulder shaped to recieve said disk-shaped member; and a receptacle shaped to engage said backshell and said disk-shaped member and recieve said electric power lead pin such that, when said receptacle is attached to said disk-shaped member and said backshell, relative rearward movement of said power lead pin and attached power lead is prevented below a predetermined force.

3. The receptacle assembly of claim 2 wherein said disk-shaped member is made of a heat resistant material.

4. The receptacle assembly of claim 2 wherein said disk-shaped member is made of a dielectric material.

5. The receptacle assembly of claim 4 wherein said material is nylon.

6. The receptacle assembly of claim 2 wherein said predetermined force is approximately 200 pounds (889.6N).

7. The receptacle assembly of claim 2 wherein said disk-shaped member includes an annular surface positioned to engage said annular rib.

8. The receptacle assembly of claim 2 wherein said collar is shaped to clamp said annular rib against said collar when said receptacle is connected to said backshell.

9. The receptacle assembly of claim 2 wherein said receptacle includes a grommet having at least one orifice therethrough positioned to correspond to said disk-shaped member orifice when said receptacle is connected to said backshell.

10. The receptacle assembly of claim 9 wherein said grommet is made of a relatively flexible material.

11. The receptacle assembly of claim 10 wherein said flexible material is silicone rubber.

12. The receptacle assembly of claim 9 wherein said grommet includes a protruding ridge shaped to engage said recess.

13. The receptacle assembly of claim 12 wherein said grommet includes a recess positioned in between said ridge and said grommet orifice shaped to engage said annular rib.

14. The receptacle assembly of claim 13 wherein said grommet orifice includes a constriction shaped to engage said lead.

15. The receptacle assembly of claim 2 wherein said receptacle includes a receptacle housing shaped to engage said backshell.

16. The receptacle assembly of claim 15 wherein said grommet is molded to said receptacle housing.

17. The receptacle assembly of claim 16 wherein said engagement of said backshell and said receptacle housing clamps said disk-shaped member against said grommet.

18. The receptacle assembly of claim 17 wherein said engagement of said disk-shaped member and said grommet captures said annular rib therebetween.

* * * * *